US009840858B2

(12) United States Patent
Farooq et al.

(10) Patent No.: US 9,840,858 B2
(45) Date of Patent: Dec. 12, 2017

(54) DEPLOYABLE HOOD RELEASE HANDLE

(71) Applicant: FORD GLOBAL TECHNOLOGIES, LLC, Dearborn, MI (US)

(72) Inventors: Iskander Farooq, Novi, MI (US); Mohammed Omar Faruque, Ann Arbor, MI (US); Dean M. Jaradi, Macomb, MI (US); Gary Steven Strumolo, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 309 days.

(21) Appl. No.: 14/290,271

(22) Filed: May 29, 2014

(65) Prior Publication Data

US 2015/0345185 A1 Dec. 3, 2015

(51) Int. Cl.

| | |
|---|---|
| ***E05C 3/02*** | (2006.01) |
| ***E05B 83/24*** | (2014.01) |
| ***E05B 79/20*** | (2014.01) |

(52) U.S. Cl.
CPC ..... *E05B 83/24* (2013.01); *E05B 79/20* (2013.01); *Y10T 292/1043* (2015.04)

(58) Field of Classification Search
CPC ..... E05B 81/14; E05B 83/243; Y10S 292/14; Y10T 70/5903
USPC ..... 292/104, DIG. 14
See application file for complete search history.

(56) References Cited

U.S. PATENT DOCUMENTS

| | | | | |
|---|---|---|---|---|
| 3,397,906 | A * | 8/1968 | Beckman | E05B 83/16 292/108 |
| 3,966,244 | A * | 6/1976 | Kleisser | E05B 83/24 292/127 |
| 4,382,482 | A | 5/1983 | Brandl et al. | |
| 4,756,562 | A * | 7/1988 | Foster | E05B 83/24 292/28 |

(Continued)

FOREIGN PATENT DOCUMENTS

| | | |
|---|---|---|
| EP | 0604055 | 6/1994 |
| KR | 482685 | 4/2005 |

(Continued)

OTHER PUBLICATIONS

Penn State College, "Secondary Hood Release Handle," www.if.psu.edu/Projects/?pid=297 (Spring 2011).

*Primary Examiner* — Mark Williams
(74) *Attorney, Agent, or Firm* — Jason Rogers; Price Heneveld LLP

(57) ABSTRACT

A motor vehicle hood latch mechanism comprises a latch assembly including a primary latch and a secondary latch. The secondary latch restrains the hood in a released position subsequent movement of the primary latch to an unlocked position. The secondary latch secures a striker to restrain the hood in a released position and allows the hood to move to an open position upon manipulation. An improved secondary latch release handle comprises a secondary latch release handle arm having a retracted position and a deployed position outside of the motor vehicle, the secondary latch release handle arm extending longitudinally forward relative the motor vehicle in each of the retracted and deployed positions, wherein the secondary latch release handle arm is extended forward to the deployed position by purely translational motion upon movement of the primary latch to the unlocked position.

17 Claims, 8 Drawing Sheets

(56) References Cited

U.S. PATENT DOCUMENTS

| | | | | |
|---|---|---|---|---|
| 4,991,884 | A * | 2/1991 | Cairns | E05B 83/24 292/28 |
| 5,000,493 | A * | 3/1991 | Bastien | E05B 83/24 292/11 |
| 5,141,265 | A * | 8/1992 | Claar | E05B 83/24 292/100 |
| 5,445,421 | A * | 8/1995 | Ferrara | E05B 83/24 292/216 |
| 5,853,060 | A | 12/1998 | Chao et al. | |
| 6,109,670 | A | 8/2000 | Tomaszewski et al. | |
| 6,543,822 | B1 * | 4/2003 | King | E05B 83/24 292/214 |
| 6,666,483 | B2 * | 12/2003 | Baniak | E05B 83/24 292/123 |
| 7,204,526 | B2 * | 4/2007 | Seo | E05B 83/24 292/24 |
| 7,530,609 | B2 * | 5/2009 | Beauchamp | E05B 83/24 292/126 |
| 9,476,233 | B2 * | 10/2016 | Uyanik | |
| 2013/0221685 | A1 | 8/2013 | Polewarczyk et al. | |
| 2015/0191943 | A1 | 7/2015 | Tieman | |

FOREIGN PATENT DOCUMENTS

| | | |
|---|---|---|
| KR | 100575175 | 5/2006 |
| WO | 2004 052674 | 6/2004 |
| WO | 2006 081367 | 8/2006 |
| WO | 2015 088461 | 6/2015 |

* cited by examiner

DEPLOYABLE HOOD RELEASE HANDLE

FIELD OF THE INVENTION

The present invention generally relates to a hood latch release handle for a motor vehicle, specifically a secondary latch release handle arm that is deployed longitudinally forward upon disengagement of the primary latch.

BACKGROUND OF THE INVENTION

Latch assemblies for motor vehicles are generally well-known in the art. In most motor vehicles, a hood is used to enclose the engine or luggage compartment of the motor vehicle. Such hoods are typically situated so as to be opened from the front of the vehicle and hinged along a rearward edge, such that the hood opens from the front of the vehicle. The hood is typically equipped with one or more strikers attached to the lower surface near the forward edge of the hood. The striker is situated to interact and to be restrained by the latch assembly attached to the motor vehicle chassis, likewise located proximate the forward edge of the hood. As is common in the industry, a latch release handle is typically situated in the occupant compartment, typically near the driver's side kick panel or under the instrument panel. The handle is typically connected via a bowden cable to a latch release lever operatively connected to a primary latch of the latch assembly. Upon actuation of the hood release handle in the occupant compartment, the bowden cable pulls on the latch release lever, thereby releasing the striker from the primary latch of the latch assembly. At this point, the hood is partially opened to a pre-determined height, such as about 35 to 40 mm, and is held to this position by a secondary latch.

Such secondary latches are manually operated while in front of the vehicle, such that in the event of an inadvertent release of the primary latch handle or failure of the primary latch while the vehicle is in motion, the hood will not abruptly raise due to wind pressure. Rather, the secondary latch requires an operator standing in front of the vehicle to manually operate the secondary latch to free the hood striker from the secondary latch of the latch assembly, thereby allowing the hood to be fully raised, providing access to the engine in the engine compartment and/or luggage within the luggage compartment.

Thus, in the context of such latch assemblies having primary and secondary latches, after the operator pulls the primary latch release lever from inside the passenger compartment, the hood is released from engagement with the primary latch and moved to a secondary latch release position. The operator then must move to the front of the vehicle in close proximity to the hood where the operator must then search for and locate a secondary latch release handle by inserting his or her fingers under the partially opened hood and then actuate the handle left or right (or up or down, depending the vehicle design) to release the secondary latch. The hood can then be fully opened, either manually or through some other assist mechanism, such as gas cylinders or torsion springs.

The location of the secondary latch release handle varies significantly from vehicle to vehicle. Particularly to an operator unfamiliar with the motor vehicle he or she may be operating, the secondary latch release handle can be frustratingly difficult to locate by touch alone. It is often difficult to see through the narrow, partial opening of the hood, particularly in poorly lit areas or at night. Hence, a latch assembly which overcomes these drawbacks would be advantageous.

The hood latch disclosed herein particularly accomplishes the foregoing by adapting the present typical motor vehicle hood latch assembly described above through the use of a secondary latch handle arm that is extended longitudinally forward from a retracted position to a deployed position upon disengagement of the primary latch, so that the secondary latch release handle arm is presented to the operator by forward translational motion of the extended secondary latch handle arm extending forward beyond the hood of the motor vehicle for ready actuation.

Thus, the solution presented by the present disclosure is a relatively low-cost solution that automatically presents a forward-extending and readily available secondary latch release handle arm upon the release of the primary latch, providing for convenient and confident actuation of the secondary latch release handle.

SUMMARY OF THE INVENTION

According to one aspect of the present disclosure, a motor vehicle hood latch mechanism comprises a latch assembly including a primary latch and a secondary latch. The secondary latch restrains the hood in a released position subsequent movement of the primary latch to an unlocked position. The secondary latch secures a striker to restrain the hood in a released position and allows the hood to move to an open position upon manipulation. A secondary latch release handle comprises a secondary latch release handle arm having a retracted position and a deployed position, the secondary latch release handle arm extending longitudinally forward relative the motor vehicle in each of the retracted and deployed positions, wherein the secondary latch release handle arm is extended forward of the hood to the deployed position by translational motion upon movement of the primary latch to the unlocked position.

Another aspect of the disclosure is a motor vehicle hood latch mechanism that comprises a release pawl mechanism having a release pawl rotatable between a locked position, wherein the release pawl restrains the primary latch to engage the striker, and an unlocked position, wherein the release pawl releases the primary latch from engagement with the striker, and a first resilient member urging the release pawl toward the locked position.

Still another aspect of the present disclosure is a motor vehicle hood latch mechanism, wherein the release pawl mechanism and the secondary latch release handle arm are operatively coupled to release the secondary latch release handle arm from its retracted position upon rotation of the release pawl.

Yet another aspect of the present disclosure is a motor vehicle hood latch mechanism, further comprising a secondary latch release handle arm sleeve within which the secondary latch release handle arm is slidably retained for movement between the retracted position and the deployed position, a second resilient member urging the secondary latch release handle arm to the deployed position, and a retainer releasably retaining the secondary latch release handle arm in the retracted position.

An additional aspect of the present disclosure is a motor vehicle hood latch mechanism, wherein the secondary latch release handle arm further comprises an engaging edge and the retainer comprises an engaging surface resiliently urged against the engaging edge to releasably retain the secondary latch release handle arm in the retracted position.

Another aspect of the present disclosure is a motor vehicle hood latch mechanism, wherein the engaging edge is defined in part by an inner circumference of an opening and the engaging surface is a slidable pin urged to extend into the opening by a third resilient member.

Still another aspect of the present disclosure is a motor vehicle hood latch mechanism, further comprising a release cable operatively coupled at a first end to a release pawl mechanism and coupled at a second end to the retainer.

A further aspect of the present disclosure is a motor vehicle hood latch mechanism, further comprising a pulley and wherein the release cable defines a path from the release pawl mechanism to the retainer and around the pulley.

Yet a further aspect of the present disclosure is a motor vehicle hood latch mechanism, wherein the retainer is urged to engage the secondary latch release handle arm when the secondary latch release handle is moved from the deployed position to the retracted position against the urging of the second resilient member.

An additional aspect of the present disclosure is a motor vehicle hood latch mechanism further comprising a release pawl mechanism having a release pawl rotatable between a locked position, wherein the release pawl restrains the primary latch to engage the striker, and an unlocked position, wherein the release pawl releases the primary latch from engagement with the striker, and a first resilient member urging the release pawl toward the locked position, a secondary latch release handle sleeve within which the secondary latch release handle arm is slidably retained for movement between the retracted position and the deployed position, a second resilient member urging the secondary latch release handle arm to the deployed position, and a retainer releasably retaining the secondary latch release handle arm in the retracted position, wherein the release pawl mechanism and the secondary latch release handle arm are operatively coupled to release the secondary latch release handle arm from its retracted position upon rotation of the release pawl from the locked position to the unlocked position.

Yet another aspect of the present disclosure is a hood latch comprising a primary latch releasably engaging a striker disposed proximate an edge of the hood, a secondary latch releasably engaging the striker, and a secondary latch release handle arm released to a deployed position forward of the hood by translational motion upon movement of the primary latch to an unlocked position.

A still further aspect of the present disclosure is a hood latch wherein the primary latch further has a locked position and the secondary latch release handle arm further has a retracted position, the secondary latch release handle arm extending longitudinally forward in the retracted and deployed positions, and wherein the secondary latch release handle arm moves to the deployed position from the retracted position by translational motion upon movement of the primary latch to the unlocked position.

Another aspect of the present disclosure is a hood latch further comprising a secondary latch release handle sleeve within which the secondary latch release handle arm is slidably retained for movement between the refracted position and the deployed position, a resilient member urging the secondary latch release handle arm to the deployed position, and a retainer resiliently urged to releasably retain the secondary latch release handle arm in the retracted position.

A yet additional aspect of the present disclosure is a hood latch wherein the secondary latch release handle arm is returned to the retracted position by pushing the secondary latch release handle rearwardly by translational motion until the retainer is urged to engage the secondary latch release handle arm against the urging of the resilient member.

A further aspect of the present disclosure is a hood latch further comprising an opening at a distal end of the secondary latch release handle arm within which the secondary latch release handle arm is slidably retained for translational motion between the refracted position and the deployed position, a resilient member urging the secondary latch release handle arm to the deployed position, and a retainer comprising a spring-loaded pin received in the opening to releasably retain the secondary latch release handle arm in the retracted position.

According to another aspect of the present disclosure is a hood latch for a hood having a closed locked position, a released position, and an open position, wherein the secondary latch restrains the hood in the released position subsequent movement of the primary latch to the unlocked position, the secondary latch being movable between a locked position, wherein the secondary latch secures the striker to restrain the hood in the released position, and an unlocked position, wherein the secondary latch allows the hood to move to the open position.

Still another aspect of the present disclosure is a hood latch further comprising a release pawl mechanism having a release pawl rotatable between a locked position, wherein the release pawl restrains the primary latch to engage a striker on the hood, and an unlocked position, wherein the release pawl releases the primary latch from engagement with the striker, and a resilient member urges the release pawl toward the locked position.

Yet another aspect of the present disclosure is a hood latch wherein the release pawl mechanism and the secondary latch release handle arm are operatively coupled to release the secondary latch release handle arm from its retracted position upon rotation of the release pawl.

According to a further aspect of the present disclosure, a method of unlatching a hood of a motor vehicle hood having a striker disposed proximate an edge of a hood having a closed locked position, a released position, and an open position, and comprises the steps of attaching a latch assembly to a chassis member of the motor vehicle proximate the striker for releasably engaging the striker to restrain the hood in the closed locked position, the latch assembly including a primary latch movable between a locked position, wherein the primary latch secures the striker to restrain the hood in the closed locked position, and an unlocked position, wherein the primary latch allows the hood to move to the released position, and a secondary latch restraining the hood in the released position subsequent movement of the primary latch to the unlocked position, the secondary latch movable between a locked position, wherein the secondary latch secures the striker to restrain the hood in the released position, and an unlocked position, wherein the secondary latch allows the hood to move to the open position, coupling a secondary latch release handle arm having a retracted position and a deployed position to the primary latch, the secondary latch release handle arm extending longitudinally forward relative the motor vehicle in each of the retracted and deployed positions, and moving the secondary latch release arm from the retracted position to the deployed position by translational motion by moving the primary latch from the locked position to the unlocked position.

According to another aspect of the present disclosure, the method of unlatching the hood of a motor vehicle hood further comprises the step of returning the secondary latch release handle arm to the retracted position by pushing the secondary latch release handle rearwardly by translational motion until a retainer is urged to engage the secondary latch release handle arm against the urging of a resilient member.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 2:
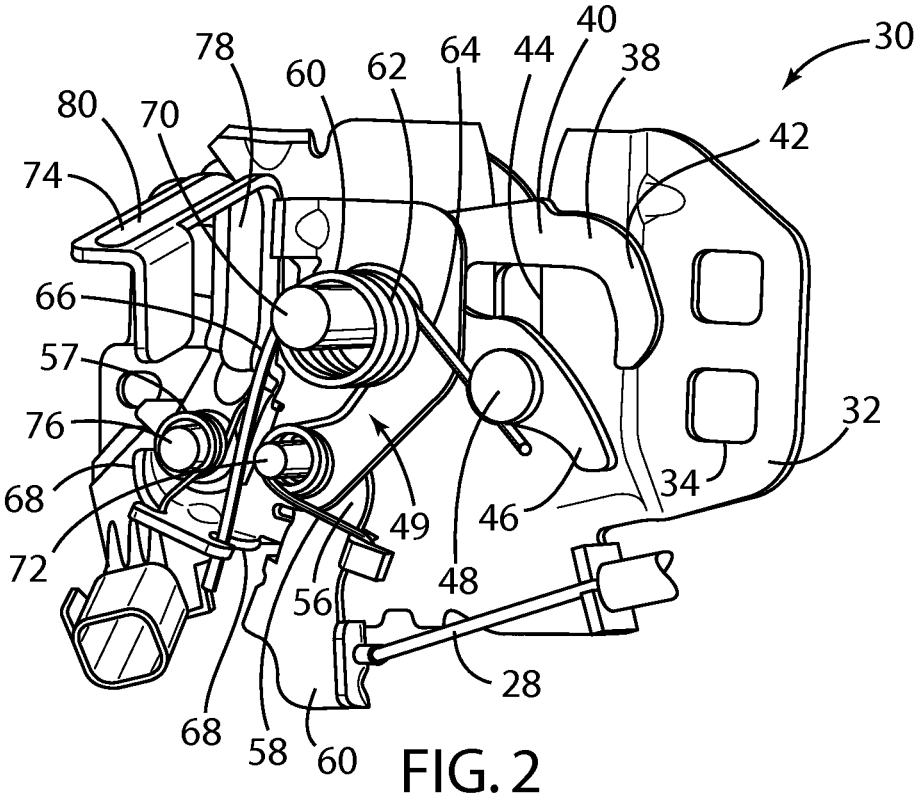
FIG. 2 PRIOR ART
FIG. 2 is a front side perspective view of the hood latch of the prior art with the latch placed in the locked position.
Figure 3:
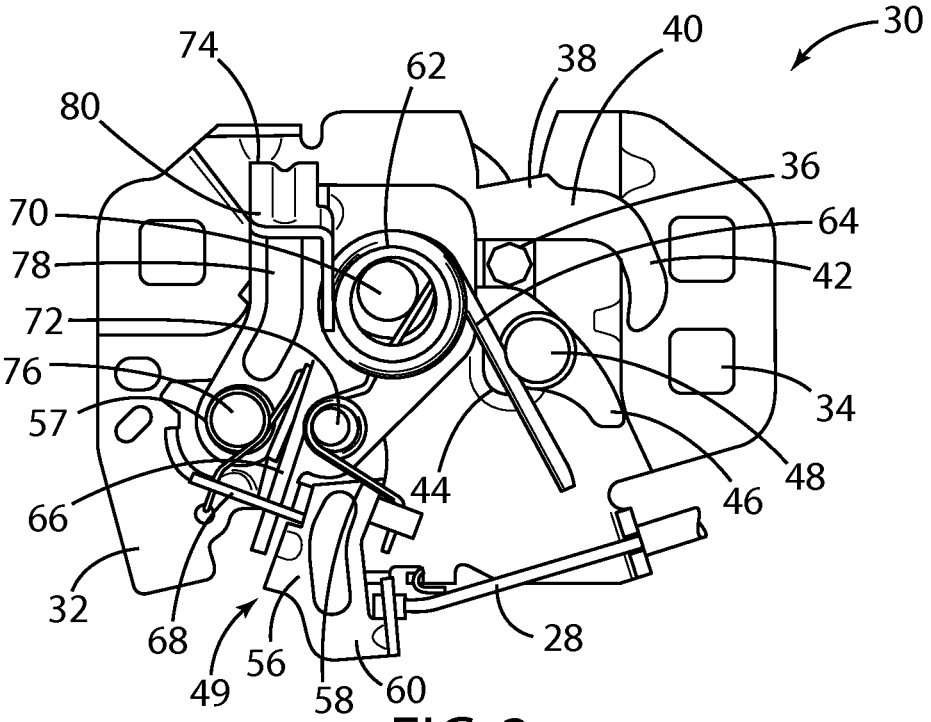
FIG. 3 PRIOR ART
FIG. 3 is a front plan view of the hood latch of the prior art with the latch placed in the locked position.

For purposes of description herein, the terms "upper," "lower," "right," "left," "rear," "front," "vertical," "horizontal," and derivatives thereof shall relate to the latch as oriented in FIG. 2. However, it is to be understood that the latch may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
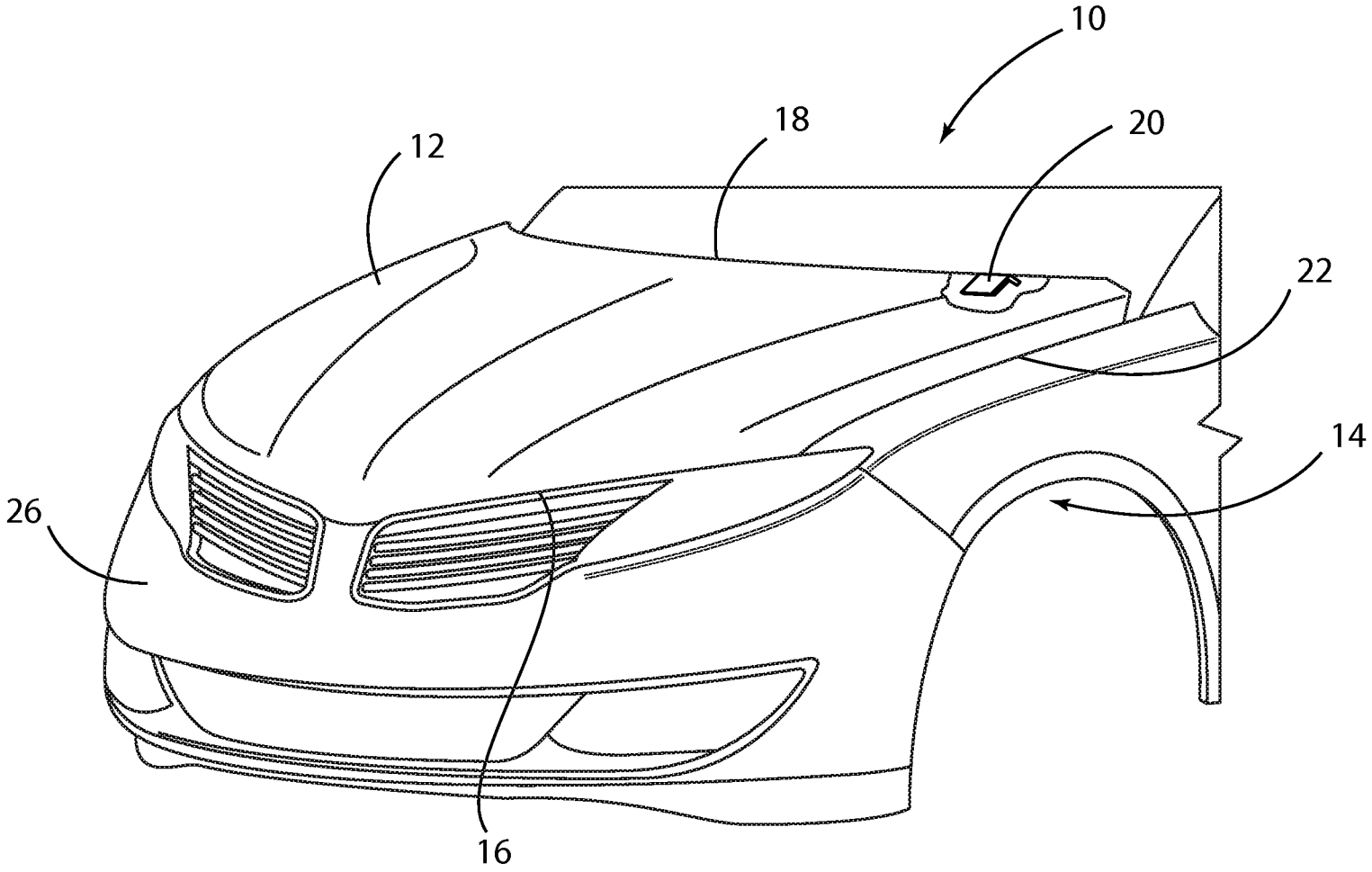
FIG. 1 is a front side perspective view of a motor vehicle incorporating the hood latch in accordance with the prior art.

Motor vehicle 10 includes a hood 12 covering an engine compartment 14. Hood 12 is generally formed as a panel having a forward edge 16 and a rearward edge 18. Hood 12 may be connected to the body of the motor vehicle 10 by hinges 20. In the closed position shown in FIG. 1, hood 12 is disposed adjacent and extends across an opening 22 in the body of motor vehicle 10, providing access to an engine compartment 14. Hood 12 is releasably connected to the motor vehicle 10 by a hood latch 30 and is pivotable relative to the motor vehicle 10 to move between an open position and a closed position. In the described example, hood latch 30 is located adjacent the forward edge 16 of the hood and the hinges 20 may be located at the rearward edge 18 of hood 12.

Motor vehicle 10 may be provided with a deformable forward section 26 extending generally forward of the forward edge 16 of hood 12 and engine compartment 14. It is contemplated that the deformable forward section 26 will deform upon contact with an object in a collision to absorb the impact force associated with the collision. It is also contemplated that the forward edge 16 of the hood 12 may be designed to allow for deformation upon impact with an object should the vehicle not include a deformable forward section 26.

Referring now to FIGS. 2-9, the latch assembly 30 is shown. FIGS. 2-6 generally show an existing hood latch 30 for a motor vehicle, while FIGS. 7-12 show a hood latch 30 equipped with the improvement disclosed herein. The hood latch 30 includes a latch mounting bracket 32 attached via mounting holes 34 to a front chassis member or base via fasteners (not shown) extending transverse and parallel to the lateral axis of the motor vehicle, as is well-known in the art. The latch assembly 30 interacts with a striker 36 disposed on the forward edge 16 of the hood 12 relative to the motor vehicle. The hood 12 has a closed locked position, a released position, and an open position. In the closed locked position, seen in FIG. 4A, the hood 12 cannot be raised and is restrained in place by a latch 38 capturing and restraining the striker 36. The latch 38 has a primary latch portion 40 extending transversely and a secondary latch portion 42 depending from the primary latch portion 40 and normal to the primary latch portion 40 and extending in a downward direction to create a hook-shaped structure, as shown. In the release position, best seen in FIG. 4B, the primary latch 40 is released but the secondary latch portion 42 is not, thereby allowing the hood 12 to be raised, typically 35 to 40 mm. In the open position, best seen in FIG. 4C, both the primary and the secondary latch portions 40, 42 are in the open position, and the hood 12 may be raised as described previously. The primary latch portion 40 restrains the hood 12 in the closed locked position within a channel 44 configured to receive the striker 36, as shown. The latch 38 also includes a lower portion 46 to which a latch engagement stud 48 is attached, as will be described further below.

Figure 4C:
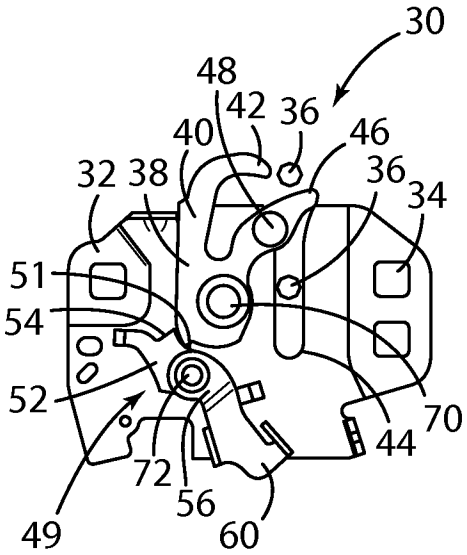
FIG. 4C PRIOR ART
FIG. 4C is a front plan view of the hood latch of the prior art in the open position.
Figure 4B:
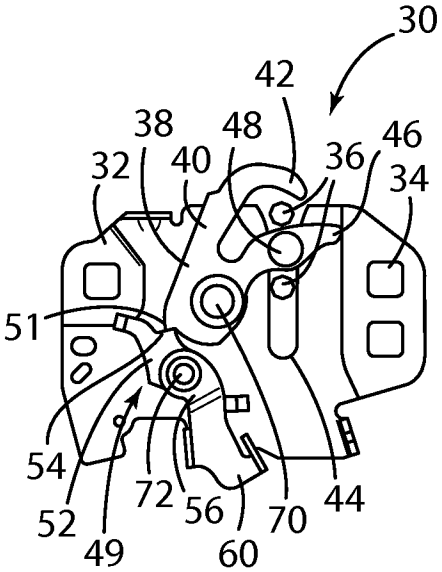
FIG. 4B PRIOR ART
FIG. 4B is a front plan view of the hood latch of the prior art in the released and partially open position.
Figure 4A:
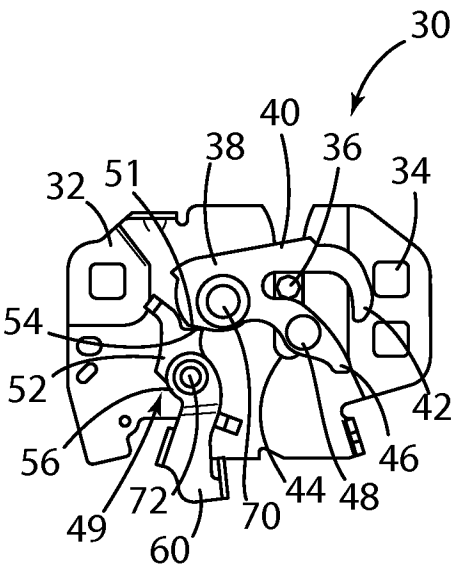
FIG. 4A PRIOR ART
FIG. 4A is a front plan view of the hood latch of the prior art in the locked position.
Figure 5:
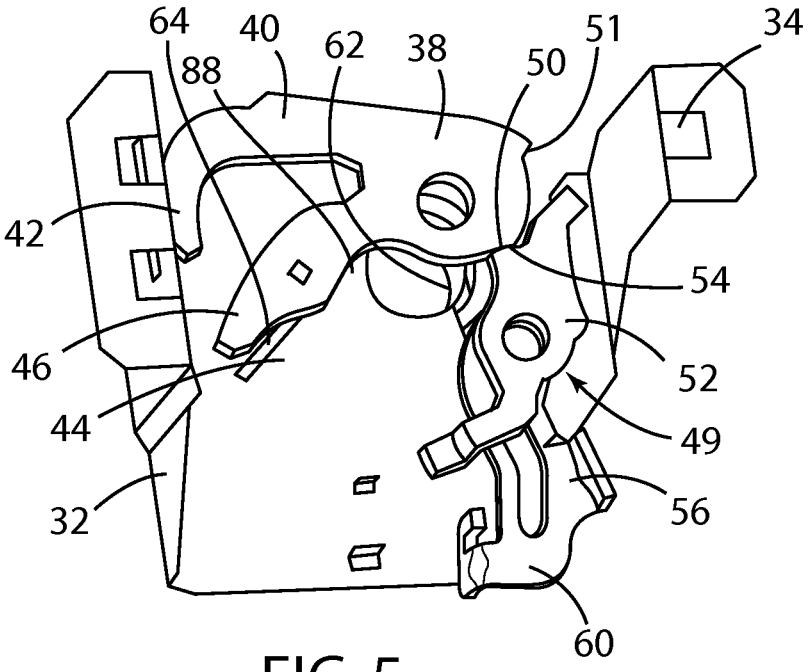
FIG. 5 PRIOR ART
FIG. 5 is a rear perspective view of the pawl release lever of the hood latch of the prior art in the locked position.
Figure 6:
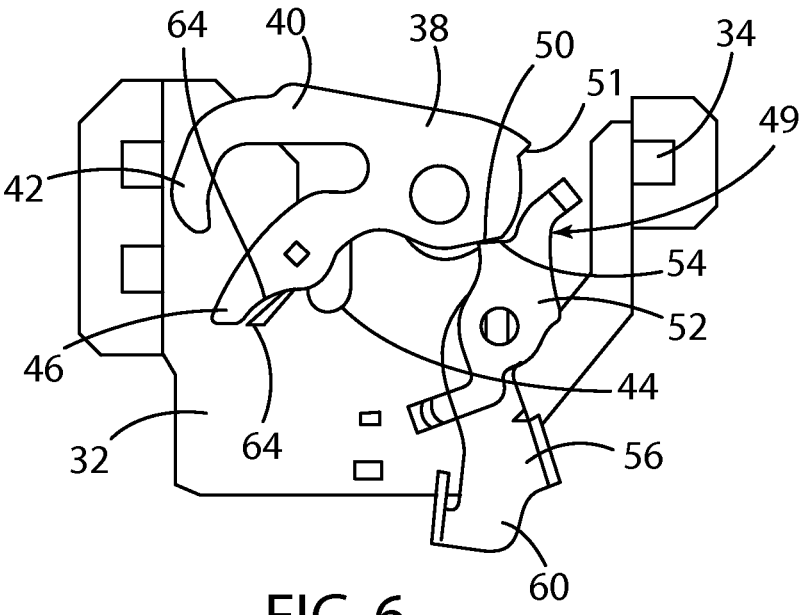
FIG. 6 PRIOR ART
FIG. 6 is a rear plan view of the pawl release lever of the hood latch of the prior art in the locked position.

The latch 38 further includes a pawl engaging primary latch tab 50 and secondary latch tab 51 adapted for interaction with a release mechanism 49 comprising a release pawl 52 pivotally mounted to the bracket 32 to receive and engage the primary latch tab 50, as best shown in FIGS. 5-6, and a primary release lever 56. The release pawl 52 has a latch cam engaging surface 54 and is operatively coupled with the primary release lever 56. The release pawl 52 and primary release lever 56 are urged into contact with the latch 38 via pawl torsion spring 58. A distal end 60 of the primary release lever 56 is connected to a bowden primary hood release cable 28 that, as described above, is in turn connected to the hood latch release lever inside the occupant compartment. A latch torsion spring 62 is provided about the pivot bolt axis 70 of the latch 38. The latch torsion spring 62 has an upper leg 64 and lower leg 66. The upper leg 64 is disposed adjacent the latch engagement stud 48, while the lower leg 66 is restrained in a lower notch 68 in the bracket 32. The latch torsion spring 62 thus urges the latch 38 into a counterclockwise rotation (as shown in FIGS. 4A-4C) about latch pivot bolt 70, urging the latch 38 to raise from the closed locked position to the release position and ultimately to the unlocked position.

The pawl torsion spring 58 is situated below the latch pivot bolt 70 about a pawl spring pivot bolt 72 and operates to urge the primary release lever 56 and the mechanically coupled pawl 52 into successive engagement with the primary and secondary latch tabs 50, 51 relative to the latch cam engaging surface 54 of the pawl 52. That is, in the closed locked position, the primary latch portion 40 engages and captures the striker 36 within the channel 44. The primary latch tab 50 of the latch 38 is engaged by the latch cam engaging surface 54, with both being urged into contact with one another. As the bowden cable is actuated, the primary release lever 56 is rotated counterclockwise, as seen in FIG. 4A, causing the release pawl 52, also rotatably mounted about the pawl spring pivot bolt 72, to rotate in the counterclockwise direction as well, thereby removing the pawl 52 from engagement with the pawl engaging tab 50 of the latch 38. Thus, urged by the latch torsion spring 62, the latch 38 likewise rotates in a counterclockwise direction to the first released position, shown in FIG. 4B. As the striker 36 is caught between the secondary latch portion 42 and the lower portion 46 within the channel 44, the striker 36 is likewise placed within the hood latch 30 to a released position within the bracket 32. While in the release position just described, the striker 36 is nonetheless restrained by the secondary latch portion 42 such that it is unable to exit from the channel 44 and is thereby restrained by the latch 38 from any further travel by the latch cam engaging surface 54 abutting the secondary latch tab 51. However, as a consequence of having traveled upwards, the striker 36, along with the forward edge 16 of the hood 12, is raised approximately 35 to 40 mm above its original position. Of course, other assist mechanisms, such as gas cylinders, may be employed in addition to torsion springs.

In normal operation, the motor vehicle operator then moves to the front of the motor vehicle 10 in close proximity to the hood 12 to search for and locate the secondary latch release handle 74 by inserting his or her fingers under the partially opened hood 12. Once located, the motor vehicle operator actuates the secondary latch release handle 74 left or right, or up or down, depending on the design. As shown, the secondary latch release handle 74, typically a one-piece stamped component, has a substantially planar base portion 78 and a fixed, forwardly extending arm 80 and is rotatably mounted about a secondary release handle pivot bolt 76 and is displaced in a counterclockwise manner and further engages the pawl 52 to cause the latch cam engaging surface 54 to move away from the secondary latch tab 51 on the latch 38, thus releasing the latch 38 to further rotate counterclockwise, thereby causing the secondary latch portion 42 to no longer impede the upward portion of the striker 36. Further, with this rotation of the latch 38, the lower portion 46 of the latch 38 urges the striker 36 in an upward direction so that the striker 36 is free of the hood latch 30. The hood 12 may be freely opened.

However, as noted previously, the location and design of the secondary latch release handle 74 varies greatly from vehicle to vehicle. The secondary latch release handle 74 is often difficult to locate by the sense of touch alone. Moreover, it is often difficult to see the secondary latch release handle 74 through the narrow, partial opening of the hood 12, especially in dark places or at night.

As shown in FIGS. 7-12, a secondary latch release handle 74 that overcomes these shortcomings is disclosed. As in previous designs, the hood 12 is held in the closed position by a hood latch striker 36 operably latched to the hood latch 30. One end of the primary hood release cable 28 is attached to the primary release lever 56 and the other end is operably attached to the inside hood release lever in the passenger compartment (not shown). As in previous designs, the hood latch 30 has a secondary release handle 74, which when operated as described above, fully opens the hood 12.

Figure 7:
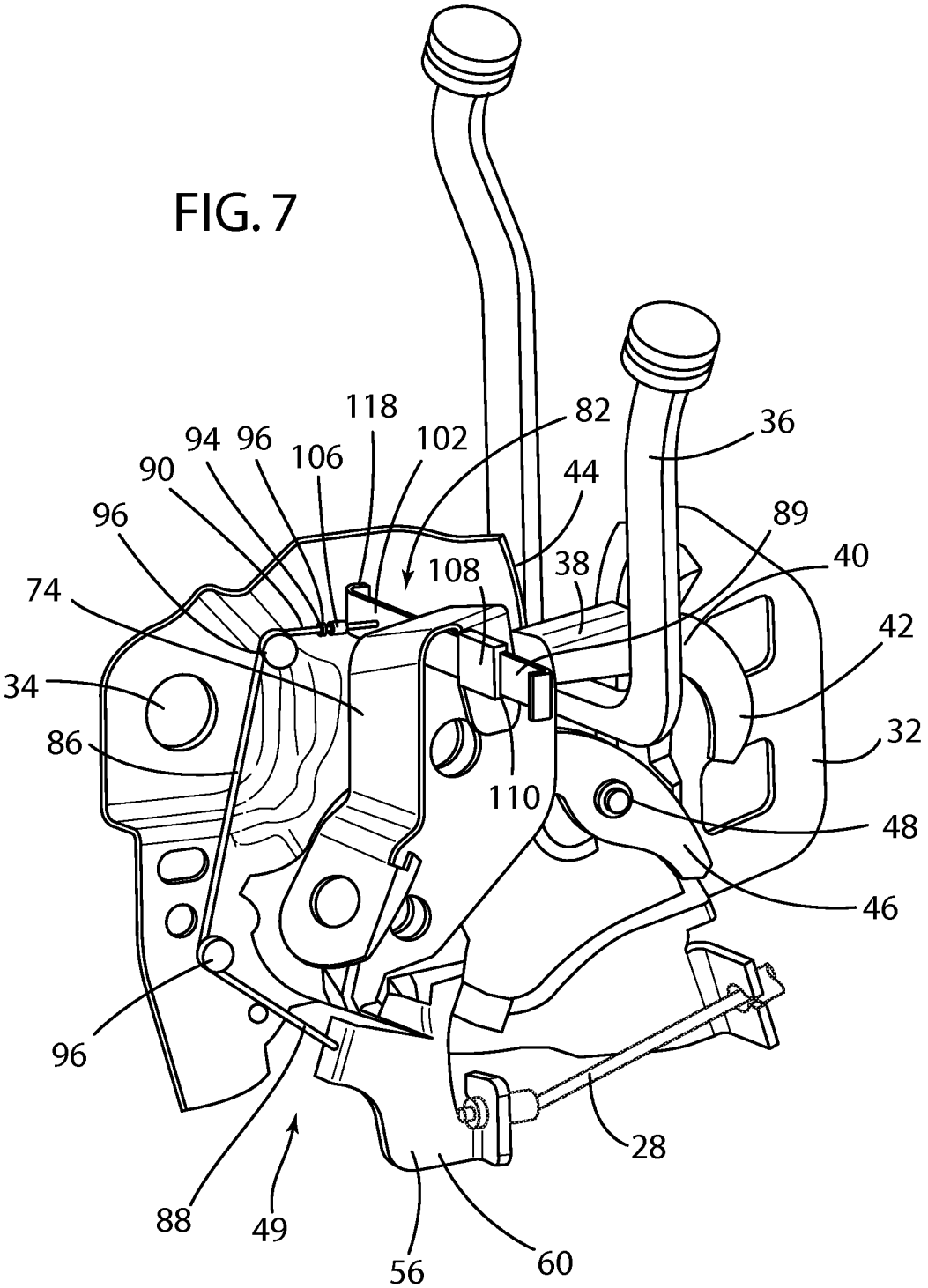
FIG. 7 is a front perspective view of the hood latch of the present disclosure with the latch in the locked position.
Figure 8:
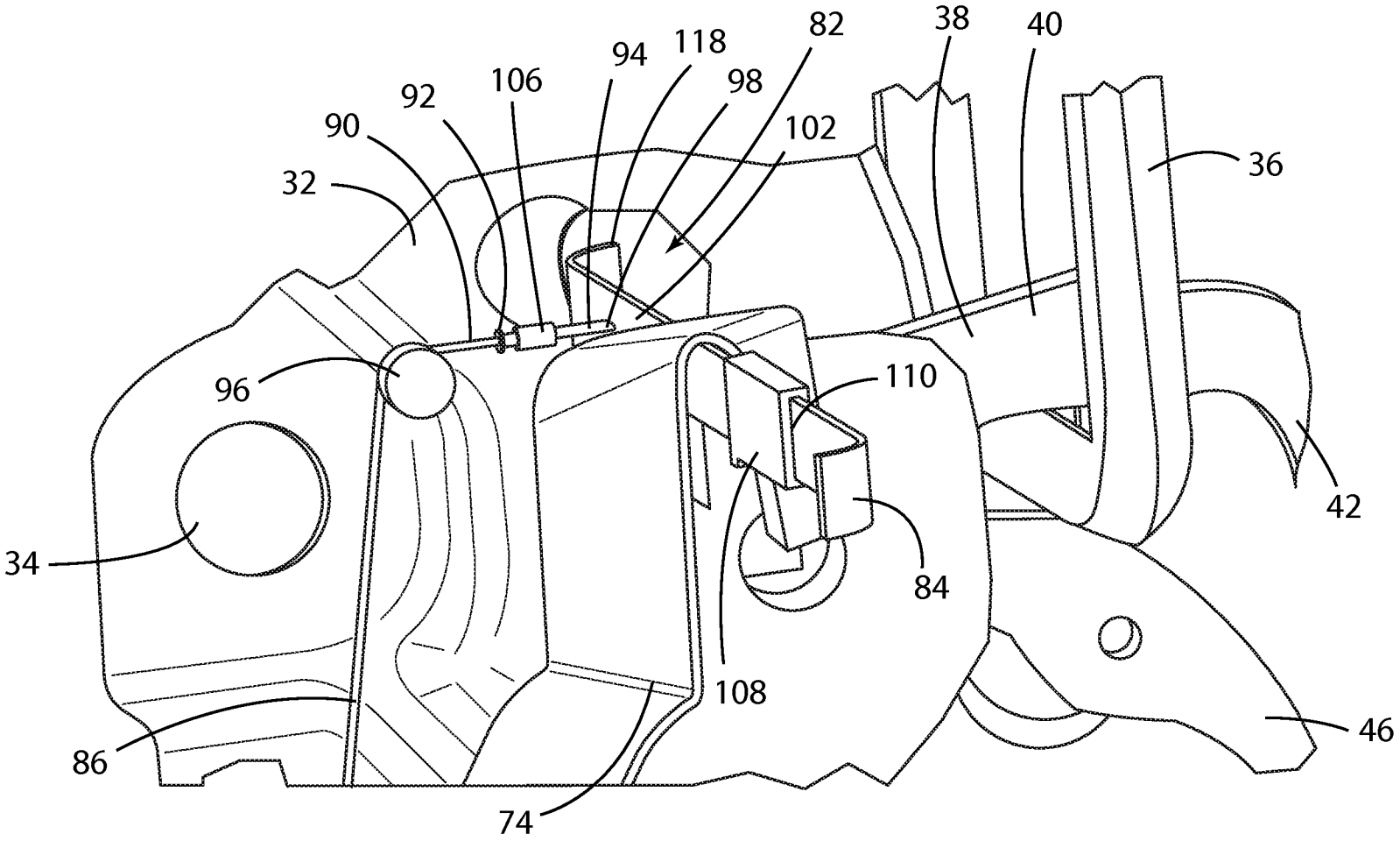
FIG. 8 is an enlarged front perspective view of the secondary latch release handle and secondary latch release handle arm in the of the present disclosure with the secondary latch release handle arm in the retracted position.

As can be seen in FIGS. 7-8, the improved secondary latch release mechanism 82 comprises a secondary latch release handle 74 having a deployable, secondary latch release handle arm 84 operatively coupled with a deployable handle release cable 86, where a first end 88 of the deployable handle release cable 86 is securely attached to the primary release lever 56 of the hood latch 30, and the other second end 90 is securely attached to a retainer 92, such as a spring-loaded pin 94, that retains or holds the deployable secondary latch release handle arm 84 in a first retracted position. Pulleys 96 are provided as needed for routing the deployable handle release cable 86 about the hood latch 30. As shown, a pair of pulleys 96 is provided.

Figure 10:
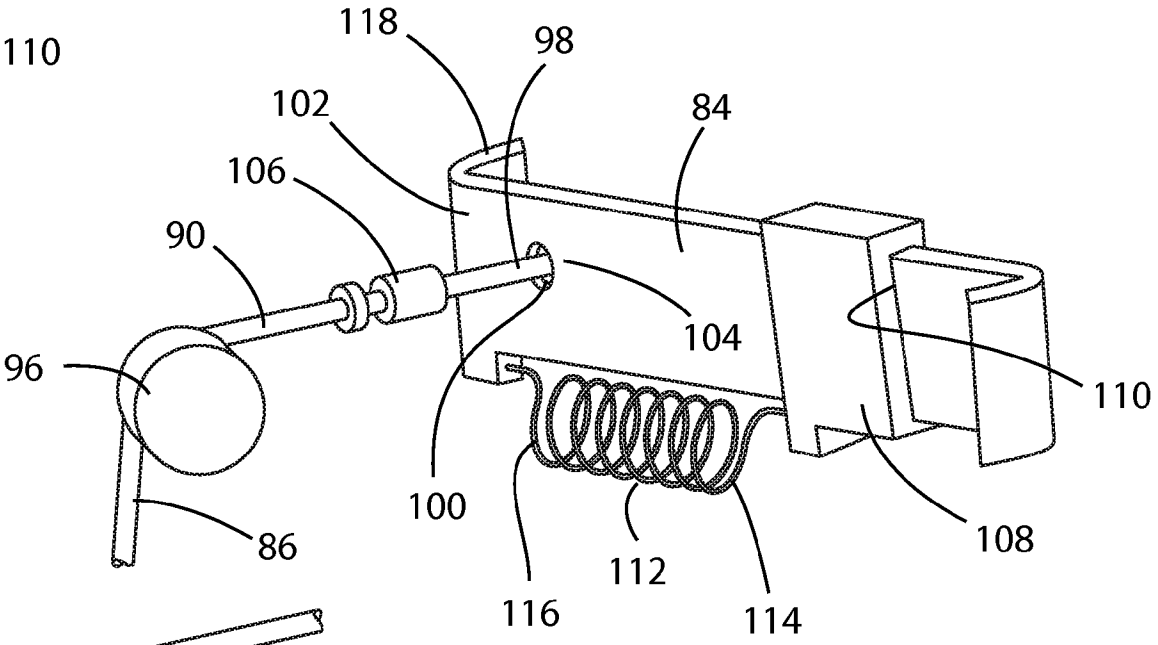
FIG. 10 is an enlarged front perspective view of the secondary latch release handle arm and retainer of the present disclosure with the secondary latch release handle arm in the retracted position.

The deployable secondary latch release handle arm 84 is thus retained by the spring-loaded pin 94 in the retracted position when the hood 12 is latched at the primary latch position shown in FIG. 4A. As can be seen in FIG. 10, the end 98 of the spring-loaded pin 94 is inserted into an opening 100, such as a hole or a slot, at a distal end 102 of the deployable secondary latch release handle arm 84. The inner circumference 104 of the opening 100 thus creates an engaging edge, and the sliding end 98 of the spring-loaded pin 94 thus creates an engaging surface resiliently urged against the engaging edge to releasably retain the deployable secondary latch release handle arm 84 in the refracted position. The opening 100 is somewhat larger than the outer diameter of the spring-loaded pin 94 as required in order to allow for manufacturing tolerances, so that the deployable secondary latch release handle arm 84 is consistently retained in a secure manner. The spring 106 for the spring-loaded pin 94 can be held securely in position by welding or fastening it to the latch mounting bracket 32.

As shown in FIG. 8, the deployable secondary latch release handle arm 84 is held in position by a deployable secondary latch release handle arm sleeve 108. The deployable secondary latch release handle arm sleeve 108 is securely attached (such as by welded, bonded, or fastened) to the base portion 78 of the secondary latch release handle 74. The deployable secondary latch release handle arm sleeve 108 also allows the deployable secondary latch release handle arm 84 to slide within its slot 110 from the retracted position, as shown in FIGS. 7-8, to a deployed position, and vice versa. The deployable secondary latch release handle arm 84 is held in this retracted state against the urging of a deployable secondary latch release handle arm spring 112. One end 114 of the deployable secondary latch release handle arm spring 112 is attached to the fixed deployable secondary latch release handle arm sleeve 108 and the other end 116 is attached to the distal end 102 of the deployable secondary latch release handle arm 84.

Referring to FIG. 10, it can be seen that the deployable secondary latch release handle arm spring 112 is at an extended or energized state when the deployable secondary latch release handle arm 84 is in the retracted position, which in turns places a forward force on the deployable secondary latch release handle arm 84. This forward force on the deployable secondary latch release handle arm 84 is in turn resisted by the spring-loaded pin 94 and opening 100, which retain the deployable secondary latch release handle arm 84 in the retracted position by engagement of the spring-loaded pin 94 with the opening 100.

In operation, as the motor vehicle operator pulls on the passenger compartment hood release lever, the primary hood release cable 28 attached to it pulls on the primary release lever 56, which in turn releases release pawl 52, which thereby releases the primary latch portion 40 to allow the striker 36 to engage the secondary latch 42 and which allows the motor vehicle operator to partially open the hood 12. The act of pulling of the primary hood release cable 28 by the motor vehicle operator and the pulling of the primary release lever 56 also simultaneously pulls the deployable handle release cable 86, due to its attachment to the primary release lever 56. This action of the deployable handle release cable 86 then pulls the spring-loaded pin 94 from engagement with the opening 100 on the deployable secondary latch release handle arm 84.

Figure 9:
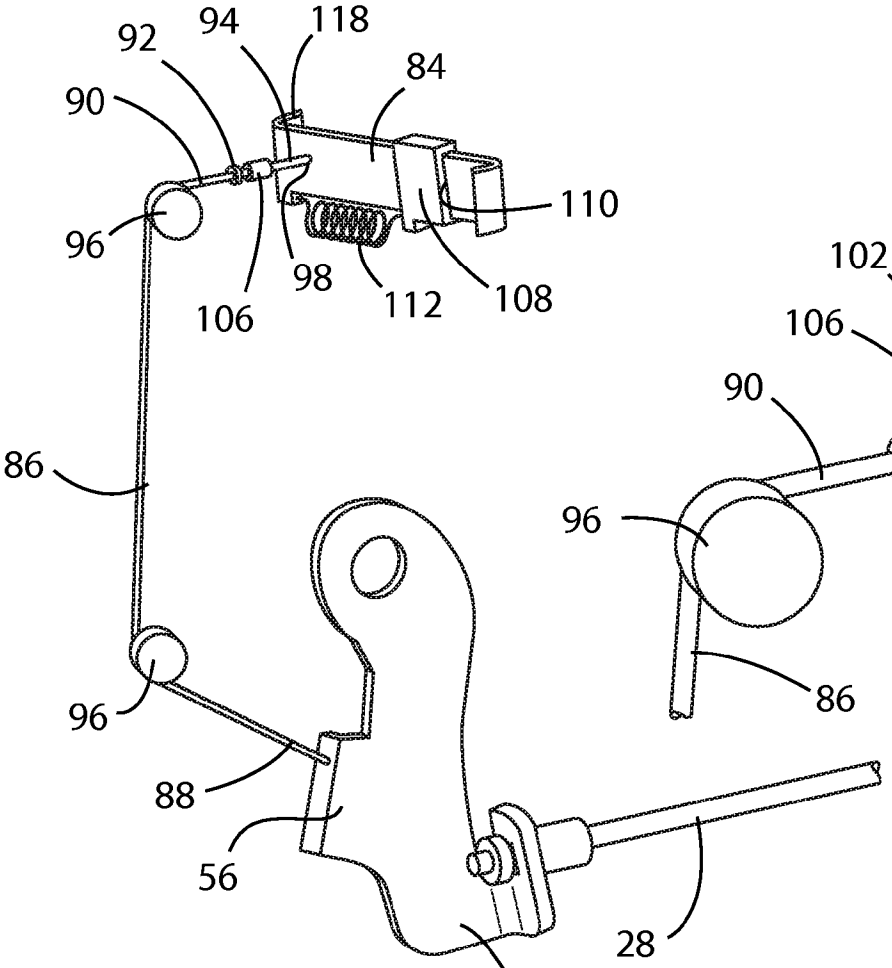
FIG. 9 is a front perspective view of the secondary latch release handle arm and retainer of the present disclosure with the secondary latch release handle arm in the retracted position.
Figure 12:
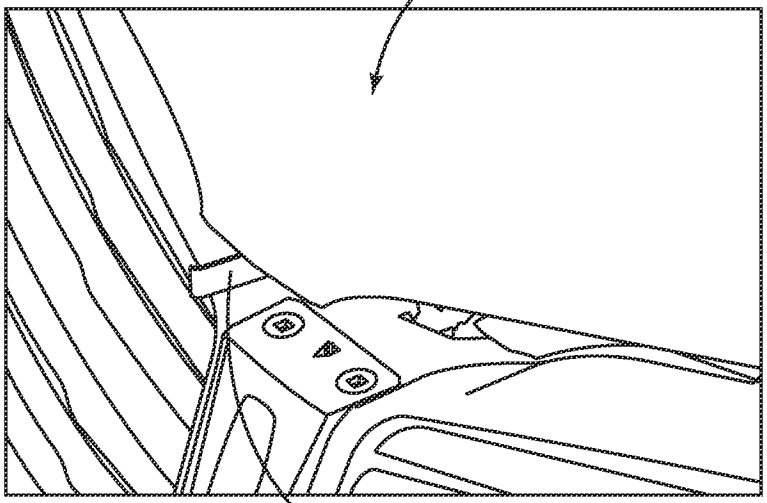
FIG. 12 is a second front side perspective view of the secondary latch release handle arm in the deployed position.
Figure 11:
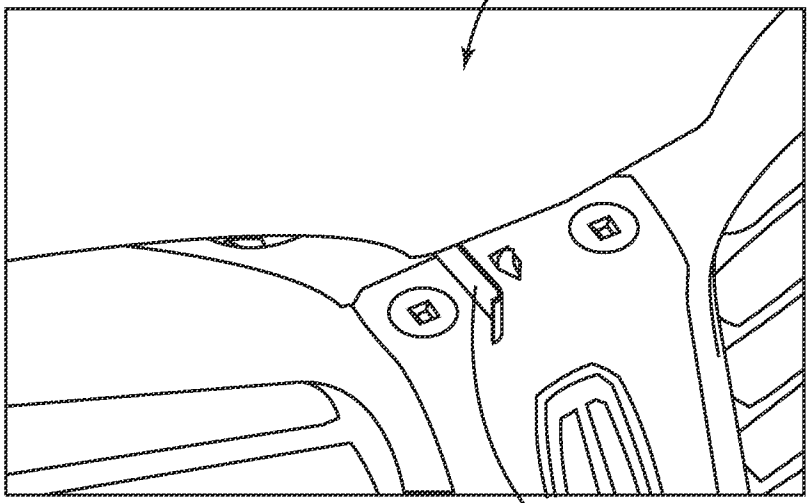
FIG. 11 is a first front side perspective view of the secondary latch release handle arm in the deployed position.

FIGS. 9 and 10 show the subsequent action of the deployment of the secondary release handle arm 84. As the spring-loaded pin 94 is pulled away and is disengaged from the opening 100 in the deployable secondary latch release handle arm 84, the deployable secondary latch release handle arm 84 then deploys forward in purely translational motion by sliding within the slot 110 of the secondary deployable latch release handle sleeve 108 toward the outside of the motor vehicle 10 through the partial opening of the hood 12 due to the urging of the deployable secondary latch release handle arm spring 112. As used herein, it is to be understood that the term "purely translational motion" refers to linear motion only, such that every point on the secondary latch release handle arm 85 moves parallel to and the same distance as every other point on the secondary latch release handle arm 84. The deployable secondary latch release handle arm spring 112 then reverts back to its contracted and non-energized state, and the deployable secondary latch release handle arm 84 is thus presented to the motor vehicle operator outside and forward of the hood 12 in its deployed state. FIGS. 11 and 12 show a rendition of such deployment and the deployable secondary latch release handle arm 84 in its forward extended position. The motor vehicle operator may then actuate the deployable secondary latch release handle arm 84, along with the secondary latch release handle 74, to the left or right (or up or down, depending on the latch design) and fully open the hood 12.

To close the hood 12, the motor vehicle operator simply pushes the deployable secondary latch release handle arm 84 back to its retracted position. The distal end 102 of the deployable secondary latch release handle arm 84 may have a curved bent portion 118, and the end 98 of the spring-loaded pin 94 may be chamfered in such a way as to facilitate the sliding of the spring-loaded pin 94 along the length of the deployable secondary latch release handle arm 84 until the end 98 of the spring-loaded pin 94 re-engages the opening 100 in the deployable secondary latch release handle arm 84. The deployable secondary latch release handle arm 84 is then thus reset to its retracted position and energized for future deployment. The motor vehicle operator can now close the hood 12 using normally accepted hood closing process.

The present disclosure thus describes a secondary latch release handle 74 that is selectively extended longitudinally forward after disengagement of the primary latch 40, so that the secondary latch release handle 74 is presented to the operator by only translational motion of the extended secondary latch release handle 74. Where the hood 12 is in or nearly in the same substantially horizontal plane as the front fascia, as is becoming a more modern trend, the hood 12 in the partially opened position thereby presents a very narrow opening within which to deploy the secondary latch handle 74. The disclosure overcomes this disadvantage by using purely translational motion of the extended secondary latch handle 74. Further, the lack of rotational motion and the lack of a cam-engaging surface to deploy the deployable secondary latch release handle arm 84 eliminate wear and potential malfunction of the secondary release handle 74 over time.

A further advantage of the present system is that the system and method can be adapted to an existing hood latch 30 by replacement of but a few components. The normal operation of the existing hood latch 30 will not be affected by secondary latch release handle arm 84 of the present disclosure, and the deployable secondary latch release handle arm 84 will only be activated when the primary latch portion 40 is released. Another further advantage of the present system is a secondary latch release handle 74 that requires minimum package volume and therefore has a minimum footprint normal to the vehicle front plane.

The secondary latch release handle 74 disclosed here thus automatically extends outside of the motor vehicle 10 through the partial opening of the hood 12 when the operator disengages the primary latch portion 40. The operator then simply actuates the deployable secondary latch release handle arm 84 left or right (or up or down per the latch design intent) and fully opens the hood 12. There is no need to kneel down, look for the handle under the hood 12 in darkness, or try to feel for it blindly and locate it by using one's fingers. Actuation action is also unhindered as there are no space constraints outside of the vehicle 10 to interfere with operation of the secondary latch release handle arm 84.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A motor vehicle hood latch mechanism for engaging a striker disposed proximate an edge of a hood having a closed locked position, a released position, and an open position, the motor vehicle hood latch mechanism comprising:

a latch assembly attached to a chassis member of the motor vehicle and adapted to releasably engage the striker to restrain the hood in the closed locked position, the latch assembly including a primary latch movable between a locked position, wherein the primary latch secures the striker to restrain the hood in the closed locked position, and an unlocked position, wherein the primary latch allows the hood to move to the released position, a secondary latch restraining the hood in the released position subsequent movement of the primary latch to the unlocked position, the secondary latch movable between a locked position, wherein the secondary latch secures the striker to restrain the hood in the released position, and an unlocked position, wherein the secondary latch allows the hood to move to the open position; and a secondary latch release handle comprising a secondary latch release handle arm having a retracted rearward position and a deployed forward position such that when in the deployed forward position, the secondary latch release arm is adapted to extend outside of the motor vehicle in a manner such that the secondary latch release arm is clearly visible to a person located adjacent a front area of the hood, the secondary latch release handle arm extending longitudinally forward relative the motor vehicle in each of the retracted and deployed positions, wherein the secondary latch release handle arm is extended forward to the deployed forward position by purely translational motion upon movement of the primary latch to the unlocked position to present the secondary latch release handle arm for manipulation and actuation.

2. The motor vehicle hood latch mechanism of claim 1, further comprising a pawl mechanism having a release pawl rotatable between a locked position, wherein the release pawl restrains the primary latch to engage the striker, and an unlocked position, wherein the release pawl releases the primary latch from engagement with the striker, and a first resilient member urging the release pawl toward the locked position.

3. The motor vehicle hood latch mechanism of claim 2, wherein the release pawl mechanism and the secondary latch release handle arm are operatively coupled to release the secondary latch release handle arm from its retracted position upon rotation of the release pawl.

4. A motor vehicle hood latch mechanism for engaging a striker disposed proximate an edge of a hood having a closed locked position, a released position, and an open position, the motor vehicle hood latch mechanism comprising:

a latch assembly attached to a chassis member of the motor vehicle and adapted to releasably engage the striker to restrain the hood in the closed locked position, the latch assembly including a primary latch movable between a locked position, wherein the primary latch secures the striker to restrain the hood in the closed locked position, and an unlocked position, wherein the primary latch allows the hood to move to the released position, a secondary latch restraining the hood in the released position subsequent movement of the primary latch to the unlocked position, the secondary latch movable between a locked position, wherein the secondary latch secures the striker to restrain the hood in the released position, and an unlocked position, wherein the secondary latch allows the hood to move to the open position;

a secondary latch release handle comprising a secondary latch release handle arm having a retracted rearward position and a deployed forward position such that when in the deployed forward position, the secondary latch release arm is adapted to extend outside of the motor vehicle in a manner such that the secondary latch release arm is clearly visible to a person located adjacent a front area of the hood, the secondary latch release handle arm extending longitudinally forward relative the motor vehicle in each of the retracted and deployed positions, wherein the secondary latch release handle arm is extended forward to the deployed forward position by purely translational motion upon movement of the primary latch to the unlocked position to present the secondary latch release handle arm for manipulation and actuation; and a secondary latch release handle arm sleeve within which the secondary latch release handle arm is slidably retained for movement between the retracted rearward position and the deployed forward position, a second resilient member urging the secondary latch release handle arm to the deployed forward position, and a retainer releasably retaining the secondary latch release handle arm in the retracted rearward position.

5. The motor vehicle hood latch mechanism of claim 4, wherein the secondary latch release handle arm further comprises an engaging edge and the retainer comprises an engaging surface resiliently urged against the engaging edge to releasably retain the secondary latch release handle arm in the retracted position.

6. The motor vehicle hood latch mechanism of claim 5, wherein the engaging edge is defined in part by an inner circumference of an opening and the engaging surface is a slidable pin urged to extend into the opening by a third resilient member.

7. The motor vehicle hood latch mechanism of claim 4, further comprising a release cable operatively coupled at a first end to a release pawl mechanism and coupled at a second end to the retainer.

8. The motor vehicle hood latch mechanism of claim 7, further comprising a pulley and wherein the release cable defines a path from the release pawl mechanism to the retainer and around the pulley.

9. The motor vehicle hood latch mechanism of claim 4, wherein the retainer is urged to engage the secondary latch release handle arm when the secondary latch release handle is moved from the deployed forward position to the retracted rearward position against the urging of the second resilient member.

10. The motor vehicle hood latch mechanism of claim 1, further comprising a release pawl mechanism having a release pawl rotatable between a locked position, wherein the release pawl restrains the primary latch to engage the striker, and an unlocked position, wherein the release pawl releases the primary latch from engagement with the striker, and a first resilient member urging the release pawl toward the locked position, a secondary latch release handle sleeve within which the secondary latch release handle arm is slidably retained for movement between the retracted rearward position and the deployed forward position, a second resilient member urging the secondary latch release handle arm to the deployed forward position, and a retainer releasably retaining the secondary latch release handle arm in the retracted rearward position, wherein the release pawl mechanism and the secondary latch release handle arm are operatively coupled to release the secondary latch release handle arm from its retracted rearward position upon rotation of the release pawl from the locked position to the unlocked position.

11. The hood latch of claim 1, wherein the primary latch further has a locked position and the secondary latch release handle arm further has a retracted rearward position, the secondary latch release handle arm extending longitudinally forward in the retracted and deployed positions, and wherein the secondary latch release handle arm moves to the deployed forward position from the retracted rearward position by purely translational motion upon movement of the primary latch to the unlocked position.

12. The hood latch of claim 11, further comprising a secondary latch release handle sleeve within which the secondary latch release handle arm is slidably retained for movement between the retracted rearward position and the deployed forward position, a resilient member urging the secondary latch release handle arm to the deployed rearward position, and a retainer resiliently urged to releasably retain the secondary latch release handle arm in the retracted rearward position.

13. The hood latch of claim 12, wherein the secondary latch release handle arm is returned to the retracted rearward position by pushing the secondary latch release handle rearwardly by purely translational motion until the retainer is urged to engage the secondary latch release handle arm against the urging of the resilient member.

14. The hood latch of claim 11, further comprising an opening at a distal end of the secondary latch release handle arm within which the secondary latch release handle arm is slidably retained for purely translational motion between the retracted rearward position and the deployed forward position, a resilient member urging the secondary latch release handle arm to the deployed forward position, and a retainer comprising a spring-loaded pin received in the opening to releasably retain the secondary latch release handle arm in the retracted rearward position.

15. The hood latch of claim 1, wherein the hood has a closed locked position, a released position, and an open position, and the secondary latch restrains the hood in the released position subsequent movement of the primary latch to the unlocked position, the secondary latch being movable between a locked position, wherein the secondary latch secures the striker to restrain the hood in the released position, and an unlocked position, wherein the secondary latch allows the hood to move to the open position.

16. The hood latch of claim 1, further comprising a release pawl mechanism having a release pawl rotatable between a locked position, wherein the release pawl restrains the primary latch to engage a striker on the hood, and an unlocked position, wherein the release pawl releases the primary latch from engagement with the striker, and a resilient member urges the release pawl toward the locked position.

17. The hood latch of claim 16, wherein the release pawl mechanism and the secondary latch release handle arm are operatively coupled to release the secondary latch release handle arm from its retracted rearward position upon rotation of the release pawl.

* * * * *